US008915699B2

(12) United States Patent
Brignole et al.

(10) Patent No.: US 8,915,699 B2
(45) Date of Patent: Dec. 23, 2014

(54) CIRCULATION STRUCTURE FOR A TURBO COMPRESSOR

(75) Inventors: Giovanni Brignole, Munich (DE); Carsten Zscherp, Munich (DE)

(73) Assignee: MTU Aero Engines GmbH, Munich (DE)

( * ) Notice: Subject to any disclaimer, the term of this patent is extended or adjusted under 35 U.S.C. 154(b) by 844 days.

(21) Appl. No.: 12/918,766

(22) PCT Filed: Feb. 19, 2009

(86) PCT No.: PCT/DE2009/000230

§ 371 (c)(1), (2), (4) Date: Aug. 20, 2010

(87) PCT Pub. No.: WO2009/103278

PCT Pub. Date: Aug. 27, 2009

(65) Prior Publication Data

US 2010/0329852 A1 Dec. 30, 2010

(30) Foreign Application Priority Data

Feb. 21, 2008 (DE) ..... 10 2008 010 283

(51) Int. Cl.
*F04D 29/52* (2006.01)
*F04D 29/68* (2006.01)
*F04D 29/16* (2006.01)

(52) U.S. Cl.
CPC ..... *F04D 29/526* (2013.01); *F04D 29/685* (2013.01); *F04D 29/164* (2013.01); *Y10S 415/914* (2013.01)
USPC ..... 415/58.5; 415/914

(58) Field of Classification Search
CPC .... F04D 29/164; F04D 29/526; F04D 29/685
USPC ..... 415/220, 221, 914, 58.5
See application file for complete search history.

(56) References Cited

U.S. PATENT DOCUMENTS

| | | | | |
|---|---|---|---|---|
| 1,329,480 | A * | 2/1920 | Sherbondy | 60/611 |
| 4,239,452 | A * | 12/1980 | Roberts, Jr. | 415/173.5 |
| 5,984,625 | A * | 11/1999 | Murray et al. | 415/1 |
| 6,290,458 | B1 * | 9/2001 | Irie et al. | 415/119 |
| 6,585,479 | B2 * | 7/2003 | Torrance | 415/58.5 |
| 6,619,909 | B2 * | 9/2003 | Barnett et al. | 415/57.4 |
| 7,210,905 | B2 * | 5/2007 | Lapworth | 415/220 |
| 2002/0041805 | A1 * | 4/2002 | Kurokawa et al. | 415/119 |
| 2005/0019152 | A1 * | 1/2005 | Seitz | 415/58.5 |
| 2006/0153673 | A1 * | 7/2006 | Guemmer | 415/115 |
| 2007/0160459 | A1 * | 7/2007 | Tudor | 415/119 |

FOREIGN PATENT DOCUMENTS

| | | | |
|---|---|---|---|
| DE | 29 24 336 | A1 | 1/1980 |
| DE | 103 30 084 | A1 | 3/2004 |
| GB | 2 408 546 | A | 6/2005 |

* cited by examiner

*Primary Examiner* — Ned Landrum
*Assistant Examiner* — Joshua R Beebe
(74) *Attorney, Agent, or Firm* — Crowell & Moring LLP

(57) ABSTRACT

A circulation structure for a turbo compressor, in particular for a compressor of a gas turbine, is disclosed. The circulation structure includes at least one annular chamber that can be traversed in a circumferential direction, is concentric with a shaft of the turbo compressor in the region of the free blade ends of a blade ring, and radially borders a main flow channel. Several chambers that can be traversed in an axial direction are situated upstream of the or each annular chamber, when viewed from the main flow direction of the main flow channel.

14 Claims, 7 Drawing Sheets

CIRCULATION STRUCTURE FOR A TURBO COMPRESSOR

This application claims the priority of International Application No. PCT/DE2009/000230, filed Feb. 19, 2009, and German Patent Document No. 10 2008 010 283.0, filed Feb. 21, 2008, the disclosures of which are expressly incorporated by reference herein.

BACKGROUND AND SUMMARY OF THE INVENTION

The invention relates to a circulation structure for a turbo compressor. In addition, the invention relates to a turbo compressor as well as to an aircraft engine and a stationary gas turbine.

Circulation structures or recirculation structures for turbo compressors are known in the form of so-called casing treatments and hub treatments. The primary task of circulation structures called casing treatments and hub treatments is increasing the aerodynamically stable operating range of the compressor by optimizing the surge limit distance. An optimized surge limit distance makes higher compressor pressures possible and therefore a higher compressor load. The malfunctions responsible for a local flow separation and ultimately for pumping the compressor occur on the housing-side ends of the rotor blades of one or more compressor stages or on the hub-side radially inner ends of the guides blades, because the aerodynamic load in the compressor is the greatest in these regions. The flow in the region of the blade ends is stabilized by circulation structures. Stator-side circulation structures in the region of the housing-side ends of the rotor blades are called casing treatments, whereas rotor-side circulation structures in the region of the hub-side ends of the guides blades area called hub treatments.

Flow structures for a turbo compressor that are configured as casing treatments and hub treatments, which have annular chambers that can be traversed in the circumferential direction, are known from German Patent Document No. DE 103 30 084 A1. The annular chambers that can be traversed in the circumferential direction are arranged concentrically to an axis of the turbo compressor in the region of the free blade ends of a rotor blade ring or a guide blade ring, wherein the annular chambers radially border a main flow channel of the turbo compressor. Guide elements may be arranged within the annular chambers that can be traversed in the circumferential direction.

Starting herefrom, the objective of the present invention is creating a novel circulation structure for a turbo compressor.

According to the invention, several chambers that can be traversed in an axial direction are situated upstream of the or each annular chamber, when viewed from the main flow direction of the main flow channel.

The present invention proposes for the first time that several chambers that can be traversed in an axial direction be arranged upstream of the or each annular chambers that can be traversed in the circumferential direction, when viewed from the main flow direction of the main flow channel. The circulation structure according to the invention accordingly combines chambers that can be traversed in the axial direction, which do not have a circumferential connection, with at least one annular chamber, which can be traversed in the circumferential direction, wherein the or each annular chamber is situated downstream from the chamber that can be traversed in the axial direction that does not have a circumferential connection, when viewed in the main flow direction. This permits the formation of a gap vortex to be pulsatingly inhibited in terms of its development. A forming recirculation flow uses fluid that has heavy losses to influence the inflow of the rotor-side components, wherein the geometric properties of the chambers that can be traversed in the axial direction that do not have a circumferential connection generate a counter twist. Additional flow obstruction regions are shifted to the annular chambers with a circumferential connection.

Because of its simplicity, the circulation structure according to the invention guarantees very low losses. Loss-generating, three-dimensional flow phenomena may be inhibited effectively. Positive effects for the operational stability of the turbo compressor under partial load and full load with an overall positive change in the efficiency, particularly under full load, can be linked hereby. The simplicity of the circulation structure is connected with low manufacturing costs.

Preferred further developments of the invention are disclosed in the following description. Without being limited hereto, exemplary embodiments of the invention are described in greater detail on the basis of the drawings.

Figure 1:
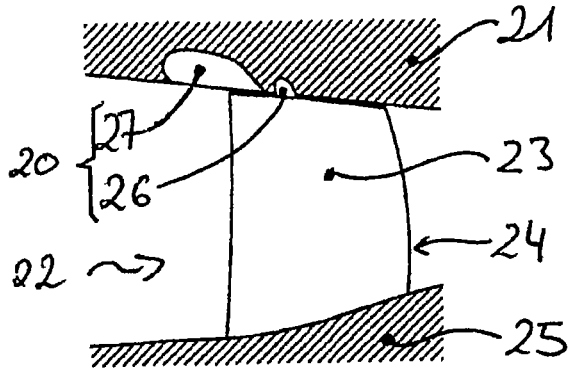
FIG. 1 is a partial longitudinal section through a compressor in the region of an inventive, housing-side circulation structure according to one exemplary embodiment.

DETAILED DESCRIPTION OF THE DRAWINGS compressor, in particular for a compressor of a gas turbine, which can be configured as a casing treatment or as a hub treatment. Making reference to FIGS. 1 to 19, the invention will be described in the following using a circulation structure configured as a casing treatment, which is positioned in a stator-side housing, which radially outwardly borders a main flow channel of the turbo compressor and attaches to free blade ends of rotor blades of a rotor-side rotor blade ring. The circulation structure according to the invention, however, may also be used analogously as a hub treatment, wherein the circulation structure is then positioned in a rotor-side hub, which radially inwardly borders the main flow channel of the turbo compressor and attaches on free blade ends of guide blades of a stator-side guide blade ring.

FIGS. 1 to 4 show different views of a housing-side circulation structure 20 according to the invention configured as a casing treatment, which is positioned in a stator-side housing 21 of a compressor of a gas turbine. The housing 21 radially outwardly borders a main flow channel 22, wherein rotor blades 23 of a rotor blade ring 24 rotate in a main flow channel 22 rotor-side. The main flow channel 22 is radially inwardly bordered by a hub 25 of the rotor.

In the exemplary embodiment in FIGS. 1 to 4, the circulation structure 20 comprises an annular chamber 26 that can be traversed in the circumferential direction, which is concentric to a shaft of the compressor in the region of the free blade ends of the rotor blades 23 of the rotor blade ring 24. The annular chamber 26 in this case radially borders the main flow channel 22. The annular chamber 26 allows flow-through in the circumferential direction and thus has a circumferential connection. The annular chamber 26 is configured as a circumferential groove, wherein guide elements for flow guidance may be situated within the annular chamber 26.

The annular chamber 26 extends completely in the region of the free blade ends of the rotor blades 23 of the rotor blade ring 24, when viewed in the axial direction. The axial extension of the annular chamber 26 is identified in this case according to FIG. 2 by the parameter b. The radial extension of the annular chamber 26 is identified by parameter t. When viewed in the main flow direction, an edge of the annular chamber 26 situated upstream is identified by ek in FIG. 4 and an edge of the annular chamber 26 situated downstream is identified by ak.

Figure 3:
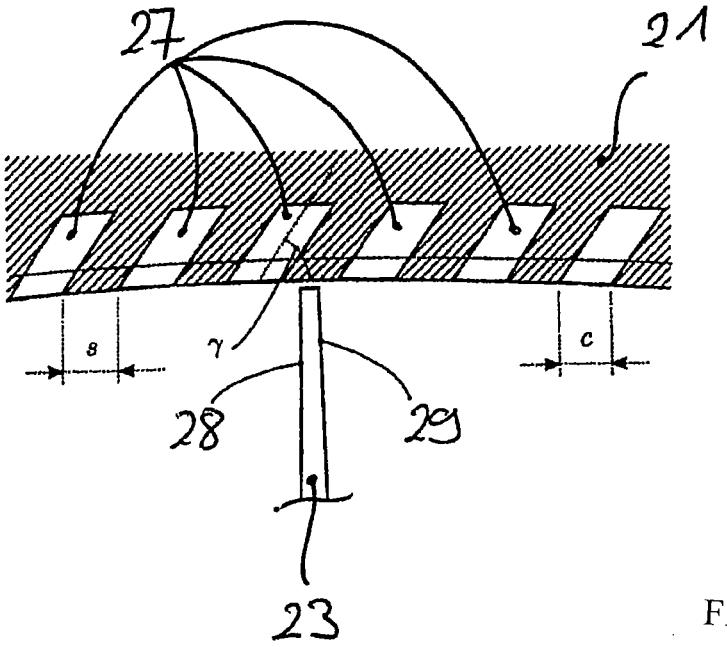
FIG. 3 is the detail from FIG. 2 viewed in an axial direction.
Figure 4:
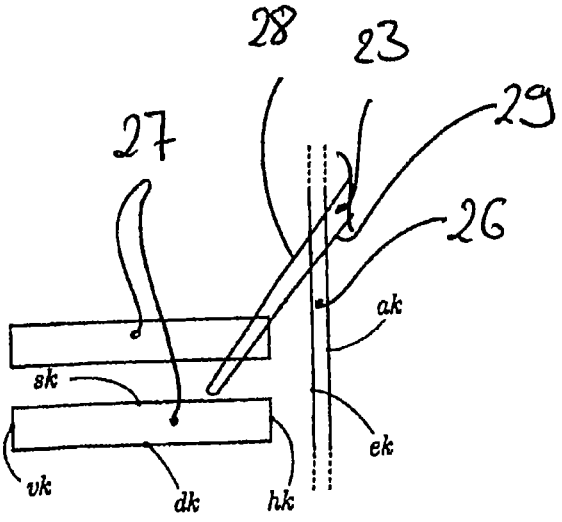
FIG. 4 is the detail from FIG. 2 viewed in a radial view.
Figure 5:
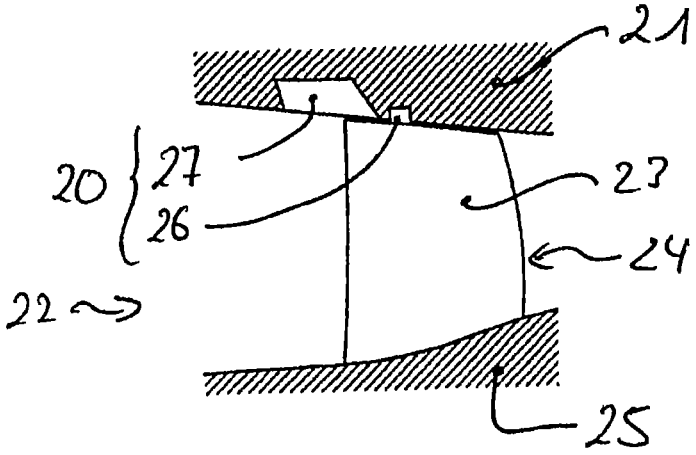
FIGS. 5 to 8 are partial longitudinal sections through compressors in an axial design in the region of an inventive, housing-side circulation structure according to other exemplary embodiments.
Figure 6:
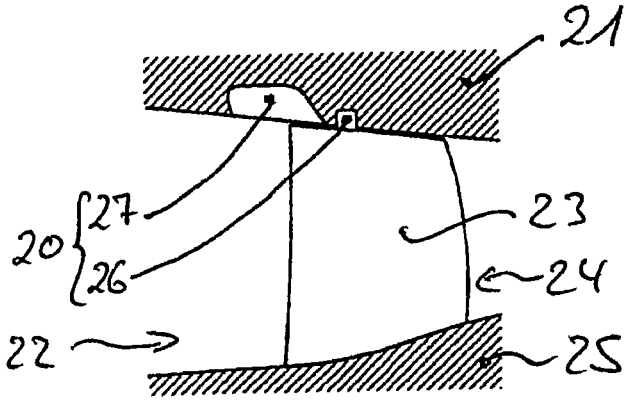
Figure 7:
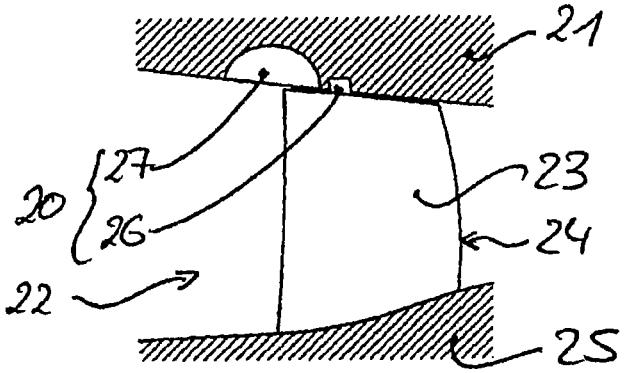

In terms of the present invention, several chambers 27 that can be traversed in the axial direction are situated upstream of the annular chamber 26, when viewed in the main flow channel 22. The chambers 27 that can be traversed in the axial direction are configured as slots or axial grooves and are not connected to one another in the circumferential direction, therefore, the chambers 27 that can be traversed in the axial direction do not have a circumferential connection. An edge of the chambers 27 that is situated upstream when viewed in the main flow direction of the main flow channel 22 is identified by vk in FIG. 4, and a downstream edge of the chambers 27, when viewed in the main flow direction of the main flow channel 22, is identified by hk in FIG. 4. A suction-side edge of the chambers 27 is identified in FIG. 4 by sk and a pressure-side edge by dk, wherein FIGS. 3 and 4 show a suction side 28 and a pressure side 29 of a rotor blade 23 of the rotor blade ring 24.

Figure 2:
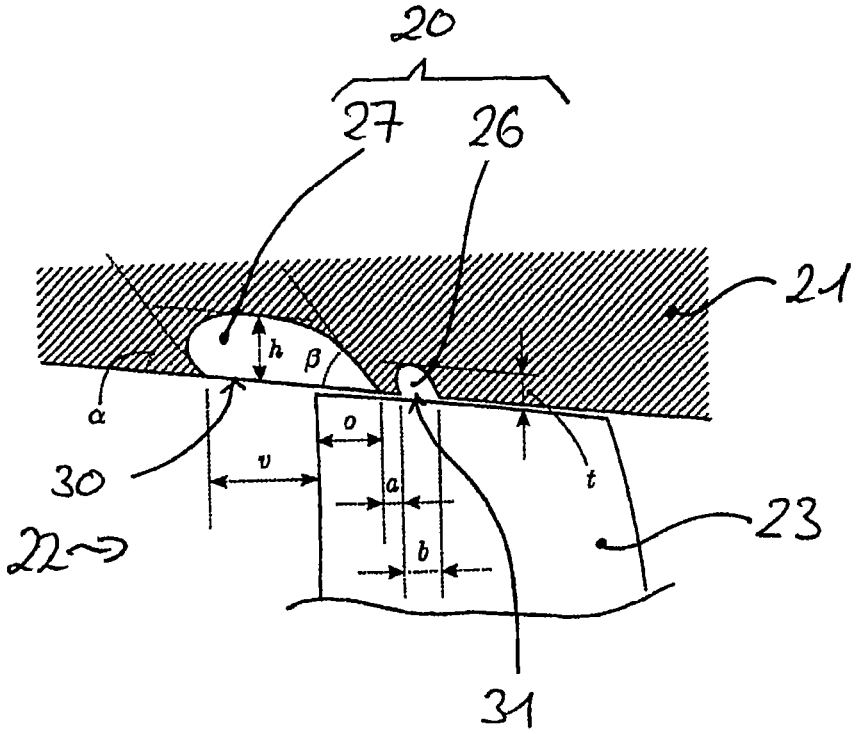
FIG. 2 is an enlarged detail from the representation in FIG. 1.

The chambers 27 that can be traversed in the axial direction are positioned in sections in the region of the free blade ends of the rotor blades 23 of the rotor blade ring 24. Thus, parameter o in FIG. 2 depicts the section of the chambers 27 that can be traversed in the axial direction, which extends in the region of the free blade ends of the rotor blades 23 and thus overlaps the rotor blade ring 24. On the other hand, the parameter v shows the section of the chambers 27 that can be traversed in the axial direction which extends completely upstream of the rotor blade ring 24.

Parameter h in FIG. 2 illustrates the radial extension or depth of the chambers 27 that can be traversed in the axial direction. A contour of the chambers 27 attaching to the upstream edge vk is inclined according to FIG. 2 by the angle $\alpha$ in relation to the radially outward contour of the main flow channel 22.

A contour of the chambers 27 attaching to the downstream edge hk is inclined in relation to the radially outward contouring of the main flow channel 22 by the angle $\beta$. In addition, according to FIG. 3, the chambers 27 that can be traversed in the axial direction are inclined in relation to the radial direction by the angle $\gamma$. When viewed in the circumferential direction, the chambers 27 that can be traversed in the axial direction have width c, wherein the chambers 27 directly adjacent in the circumferential direction have the distance s.

Connections or discharge openings 30 of the chambers 27 that can be traversed in the axial direction in the main flow channel 22 are spaced apart axially or separated axially from a connection or discharge opening 31 of the annular chamber 26, wherein according to FIG. 2, the axial distance between these discharge openings 30 and 31 is identified by the parameter a.

It is pointed out at this point that the edges ak and ek of the annular chamber 26 as well as the edges vk, hk, dk, and sk of the chambers 27 that can be traversed in the axial direction and therefore the entrance surface of some may be described by any curves or splines. Edge surfaces attaching to these edges of the annular chamber 26 as well as the chambers 27 that can be traversed in the axial direction may be defined by generic hub surfaces. The geometry of each individual chamber 27 may deviate from the other chambers 27. This applies in particular to the angle of inclination $\gamma$ of chambers 27, the circumferential distance s of the chambers 27 and the circumferential width c of the chambers 27.

In the embodiment in FIGS. 1 to 4 (see FIGS. 1 and 2 in particular), edge surfaces or outer surfaces attaching to the edges ak and ek of the annular chamber 26 and to the edges vk, hk, dk and sk of the chambers 27 are generated by the rotation of continuously differentiable curves. In contrast to this, in FIG. 5 these edges surfaces or outer surfaces are generated by a polyline, in FIG. 6 by a straight line and segments of circles and in FIG. 7 by simple geometric shapes, such as an ellipse and a rectangle.

Figure 8:
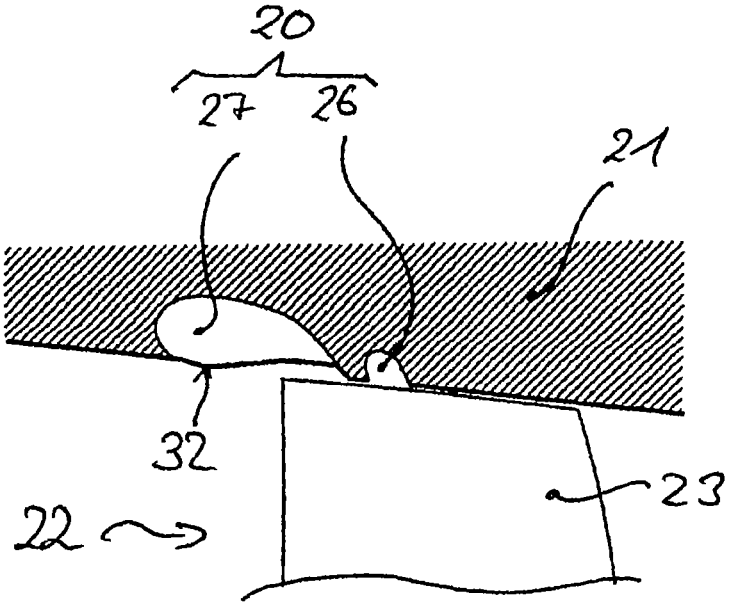

As an alternative to rotation, a local translation may also be used to generate the edge surfaces or outer surfaces of the chambers 26 and 27. FIG. 8 shows an embodiment with a contouring of the housing 21 with the formation of a radial projection 32 or a radial recess to the main flow channel 22 in the region of the chambers 27 that can be traversed in the axial direction.

The parameters $\alpha$, $\beta$, h, t and b may have any value in the exemplary embodiment in FIGS. 1 to 4. Likewise, the parameters o, v and a may assume any value, wherein, in particular to guarantee an overlapping of the chambers 27 that can be traversed in the axial direction with the free blade ends of the rotor blades 23 of the rotor blade ring 24, the parameters o and v must assume a value that is greater than zero. In addition, a thrusting out of the chambers 27 that can be traversed in the axial direction may be realized hereby upstream of an entrance edge of the rotor blades 23.

The parameter a must assume a value of greater than zero for an axial separation of the chambers 27 that can be traversed in the axial direction from the annular chamber 26 or for an axial separation of the corresponding discharge openings 30, 31.

In the exemplary embodiment in FIGS. 1 to 4 (see FIG. 4 in particular), the edges sk and dk of the chambers 27 that can be traversed in the axial direction extend straight in the axial direction of the turbo compressor. In contrast, FIGS. 9 to 15 show a deviating contouring of the suction-side edges sk and the pressure-side edges dk of the chambers 27 that can be traversed in the axial direction.

Figure 9:
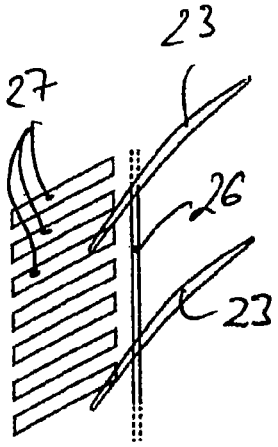
FIGS. 9 to 18 are depictions viewed in the radial direction of variations of housing-side circulation structures according to the invention.
Figure 10:
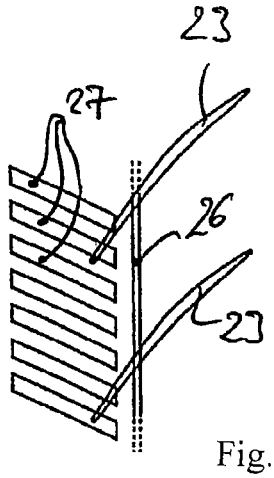
Figure 11:
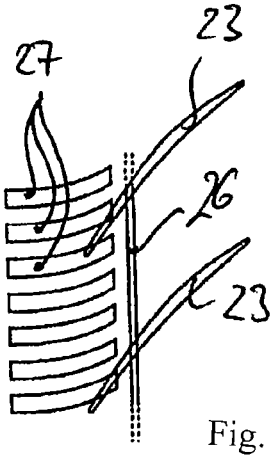
Figure 12:
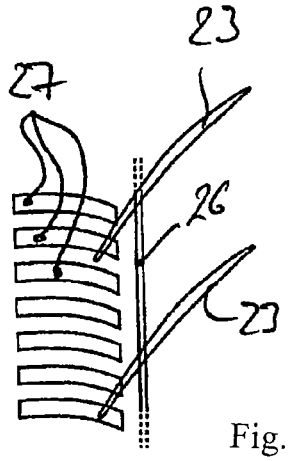
Figure 13:
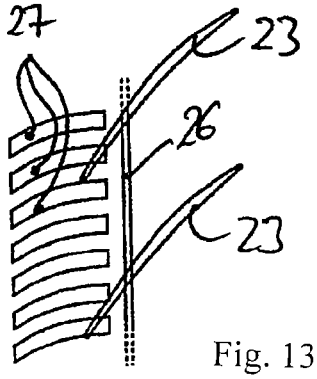
Figure 14:
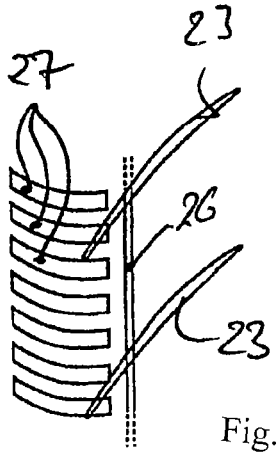
Figure 15:
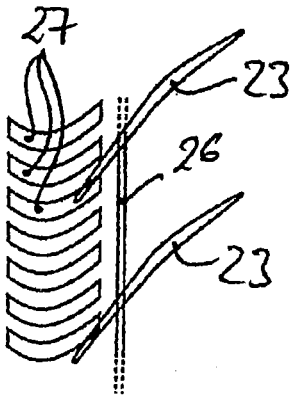

Thus, in FIGS. 9 and 10, these edges sk and dk of the chambers 27 that can be traversed in the axial direction are inclined in relation to the axial direction. In FIGS. 11 to 14, the edges sk and dk of the chambers 27 that can be traversed in the axial direction are bent in the circumferential direction, wherein in FIG. 15 the edges sk and dk of the chambers 27 run approximately tangentially to the suction side and pressure side of the rotor blades 23 in the region of the downstream edge hk.

Figure 16:
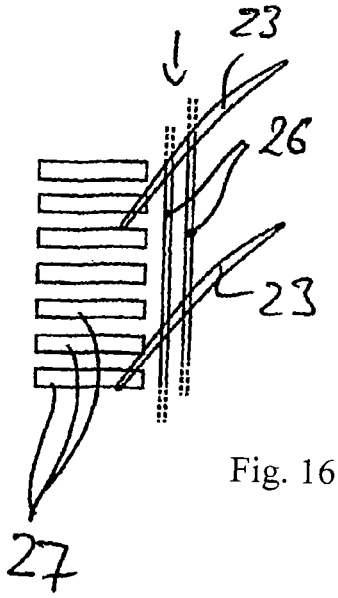

FIG. 16 shows an exemplary embodiment of the invention with two annular chambers 26, both of which, when viewed in the main flow direction of the flow channel 22, are situated downstream from the chambers 27 that can be traversed in the axial direction.

Figure 17:
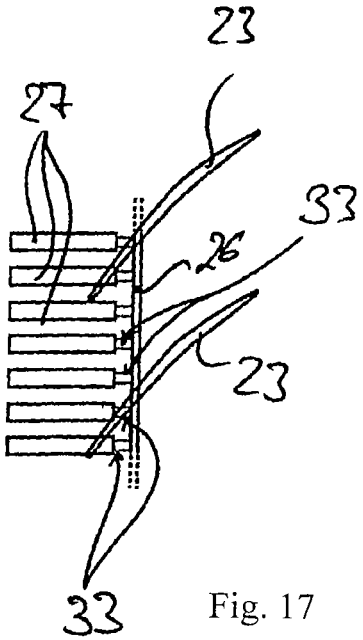

FIG. 17 shows an exemplary embodiment of the invention, in which the chambers 27 that can be traversed in the axial direction are connected to the annular chamber 26 situated downstream of same via discrete connections 33. These discrete connections 33 may be actively closed and opened via corresponding control elements in order to thereby adjust an active regulation of a flow transfer between the annular chamber 26 and the chamber 27 that can be traversed in the axial direction.

Figure 18:
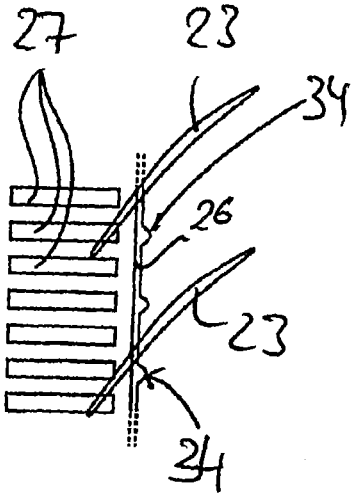
Figure 19:
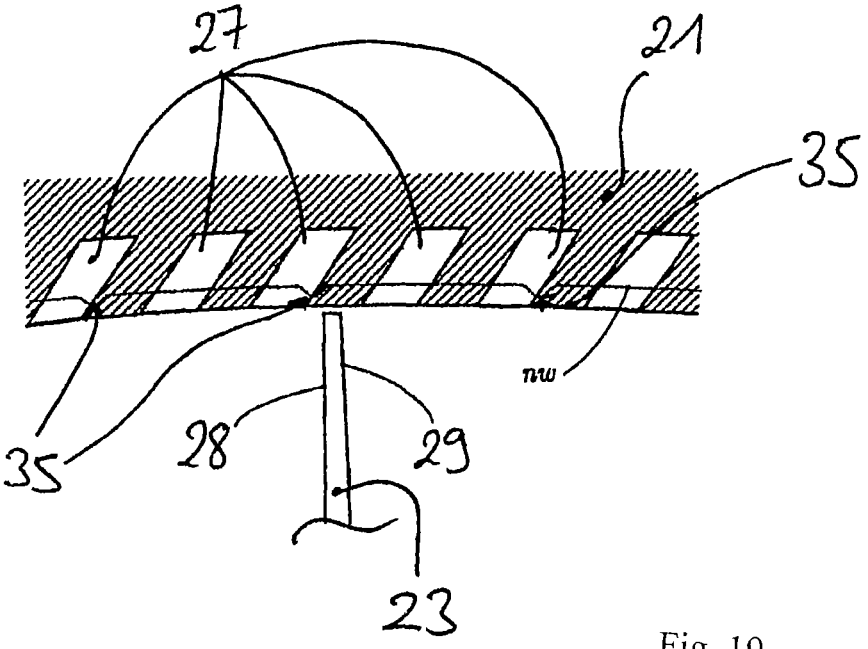
FIG. 19 is the detail from FIG. 3 according to another variation.

FIG. 18 shows an exemplary embodiment of the invention, in which the downstream edge ak of the annular chamber 26 has discrete projections 34 in order to thereby enlarge the axial extension of the discharge opening 31 of the annular chamber 26 in sections. In contrast, FIG. 19 shows a contouring of an edge surface or outside surface nw of the annular chamber 26 with discrete radial projections 35, which reduce the radial extension t of the annular chamber 26 in sections.

The invention may also be used if the turbo compressor has a tandem rotor with two directly successive rotor blade rings and/or two directly successive guide blade rings.

The circulation structure according to the invention is preferably used with turbo compressors, in particular compressors of a gas turbine configured as an aircraft engine or a stationary gas turbine.

The invention claimed is:

1. A circulation structure in a housing of a turbo compressor, comprising:

an annular chamber defined by the housing and extending within the housing that is traversable in a circumferential direction, is concentric to an axis of the turbo compressor in a region of a free blade end of a blade ring, and radially borders a main flow channel;

a plurality of chambers defined by the housing and extending within the housing that are open to the main flow channel, are traversable in an axial direction, and are situated upstream of the annular chamber when viewed from a main flow direction of the main flow channel; and a radial recess defined by the housing and extending within the housing that is open to the main flow channel, that is configured only in a region of the plurality of chambers that are traversable in the axial direction, and that is located at a position of the plurality of chambers in the axial direction.

2. The circulation structure according to claim 1, wherein the plurality of chambers are configured as slots or axial grooves which are not connected to one another in the circumferential direction.

3. The circulation structure according to claim 1, wherein the annular chamber is configured as a circumferential groove.

4. The circulation structure according to claim 1, wherein a respective connection or a discharge opening of the plurality of chambers is spaced apart axially from a connection or a discharge opening of the annular chamber.

5. The circulation structure according to claim 1, wherein the plurality of chambers are separated from the annular chamber such that no connection exists between the plurality of chambers and the annular chamber.

6. The circulation structure according to claim 1, wherein the plurality of chambers are connected to the annular chamber via a respective discrete connection.

7. The circulation structure according to claim 6, wherein the respective discrete connections are actively closable and openable via a respective control element.

8. The circulation structure according to claim 1, wherein the annular chamber extends completely in the region of the free blade end of the blade ring when viewed in the axial direction.

9. The circulation structure according to claim 1, wherein the plurality of chambers extend in a section in the region of the free blade end of the blade ring when viewed in the axial direction.

10. The circulation structure according to claim 1, wherein the plurality of chambers are thrust out upstream from a leading edge of blades of the blade ring when viewed in the main flow direction of the main flow channel.

11. A turbo compressor with at least one circulation structure according to claim 1.

12. An aircraft engine comprising a turbo compressor according to claim 11.

13. A stationary gas turbine comprising a turbo compressor according to claim 11.

14. The circulation structure according to claim 1, wherein the plurality of chambers respectively include a first section that extends in the region of the free blade end of the blade ring when viewed in the axial direction and a second section that does not extend in the region of the free blade end of the blade ring when viewed in the axial direction, wherein the first section is shorter than the second section.

* * * * *